US011264753B2

(12) United States Patent
Wang et al.

(10) Patent No.: US 11,264,753 B2
(45) Date of Patent: Mar. 1, 2022

(54) CONNECTOR

(71) Applicant: Tyco Electronics (Shanghai) Co. Ltd., Shanghai (CN)

(72) Inventors: Yunhe Wang, Shanghai (CN); Zhigang Song, Shanghai (CN); Peng Zhai, Shanghai (CN); Jiahui Chen, Shanghai (CN); Chuangpeng Zhou, Shanghai (CN); Zifu Dai, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 60 days.

(21) Appl. No.: 16/773,433

(22) Filed: Jan. 27, 2020

(65) Prior Publication Data

US 2020/0251844 A1 Aug. 6, 2020

(30) Foreign Application Priority Data

Jan. 31, 2019 (CN) ..... 201910098477.0

(51) Int. Cl.

| | |
|---|---|
| ***H01R 13/24*** | (2006.01) |
| ***H01R 12/71*** | (2011.01) |
| ***H01R 13/502*** | (2006.01) |
| *H01R 12/70* | (2011.01) |

(52) U.S. Cl.

CPC ..... *H01R 13/2407* (2013.01); *H01R 12/712* (2013.01); *H01R 13/502* (2013.01); *H01R 12/707* (2013.01)

(58) Field of Classification Search

CPC . H01R 13/2407; H01R 12/712; H01R 13/502
USPC ..... 439/63
See application file for complete search history.

(56) References Cited

U.S. PATENT DOCUMENTS

| | | | | |
|---|---|---|---|---|
| 6,758,680 | B2 * | 7/2004 | Duquerroy | H01R 24/50 439/63 |
| 6,776,668 | B1 * | 8/2004 | Scyoc | H01R 13/2421 439/295 |
| 7,416,418 | B2 * | 8/2008 | Berthet | H01R 24/50 439/66 |

(Continued)

FOREIGN PATENT DOCUMENTS

| | | |
|---|---|---|
| CN | 201518375 U | 6/2010 |
| WO | 2019074310 A1 | 4/2019 |

OTHER PUBLICATIONS

Abstract of CN 201518375, dated Jun. 30, 2010, 1 page.
Abstract of WO 2019074310, dated Apr. 18, 2019, 2 pages.

*Primary Examiner* — Neil Abrams
(74) *Attorney, Agent, or Firm* — Barley Snyder

(57) ABSTRACT

A connector includes a pair of outer conductors including a first outer conductor and a second outer conductor assembled together and slidable with respect to each other, a pair of center conductors arranged within the outer conductors, an insulation seat, and an elastic element. The center conductors include a first center conductor and a second center conductor assembled together and slidable with respect to each other. The first outer conductor and the first center conductor are fixed to the insulation seat. A first end of the elastic element abuts against the first outer conductor or the insulation seat. The first outer conductor and the first center conductor are both in electrical contact with a first electrical component under a pressing force from the elastic element.

19 Claims, 8 Drawing Sheets

(56) References Cited

U.S. PATENT DOCUMENTS

| | | | | |
|---|---|---|---|---|
| 9,590,345 | B2 * | 3/2017 | Wollitzer | H01R 13/17 |
| 10,249,968 | B2 * | 4/2019 | Dandl | H01R 12/7082 |
| 10,790,624 | B2 * | 9/2020 | Wang | H01R 24/50 |
| 10,944,193 | B2 * | 3/2021 | Meynier | H01R 12/616 |
| 2002/0081910 | A1 * | 6/2002 | Kihira | H01R 12/716<br>439/700 |
| 2020/0251844 | A1 * | 8/2020 | Wang | H01R 13/502 |
| 2021/0098849 | A1 * | 4/2021 | Park | H01R 24/42 |

* cited by examiner

CONNECTOR

CROSS-REFERENCE TO RELATED APPLICATION

This application claims the benefit of the filing date under 35 U.S.C. § 119(a)-(d) of Chinese Patent Application No. 201910098477.0, filed on Jan. 31, 2019.

FIELD OF THE INVENTION

The present invention relates to a connector and, more particularly, to a radio frequency (RF) coaxial connector.

BACKGROUND

An RF coaxial connector for connecting a Printed Circuit Board (PCB) to another PCB has a lower end welded onto a lower PCB and an upper end in electrical contact with an upper PCB. The RF coaxial connector has a contact ring serving as an upper outer conductor. The contact ring electrically contacts the upper PCB under a pressure from an external spring element. The RF coaxial connector has a shell serving as a lower outer conductor. The shell is welded onto the lower PCB to be electrically connected with the lower PCB. The contact ring and the shell are clamped together by an elastic sheet. A lower half part of a center conductor of the RF coaxial connector is welded onto the lower PCB to be electrically connected with the lower PCB. An upper half part of the center conductor is electrically contacts the upper PCB under a pressure from an interior spring element. An insulator is provided between the center conductor and the shell to ensure a relative position between the center conductor and the shell.

The center conductor has a pogo pin structure. However, a contact force between the center conductor and the PCB is completely provided by the small interior spring element in the center conductor, which leads to insufficient contact force between the center conductor and the PCB, adversely affecting the performance of the entire RF coaxial connector, especially the high-frequency performance and the Passive Inter-Modulation (PIM) performance of the RF coaxial connector. In addition, the manufacturing cost of the center conductor with the pogo pin structure is higher, and in order to ensure that the interior spring element in the center conductor has enough elastic deformation in an axial direction, an axial length of the center conductor is usually increased, increasing a length size of the RF coaxial connector.

SUMMARY

A connector includes a pair of outer conductors including a first outer conductor and a second outer conductor assembled together and slidable with respect to each other, a pair of center conductors arranged within the outer conductors, an insulation seat, and an elastic element. The center conductors include a first center conductor and a second center conductor assembled together and slidable with respect to each other. The first outer conductor and the first center conductor are fixed to the insulation seat. A first end of the elastic element abuts against the first outer conductor or the insulation seat. The first outer conductor and the first center conductor are both in electrical contact with a first electrical component under a pressing force from the elastic element.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
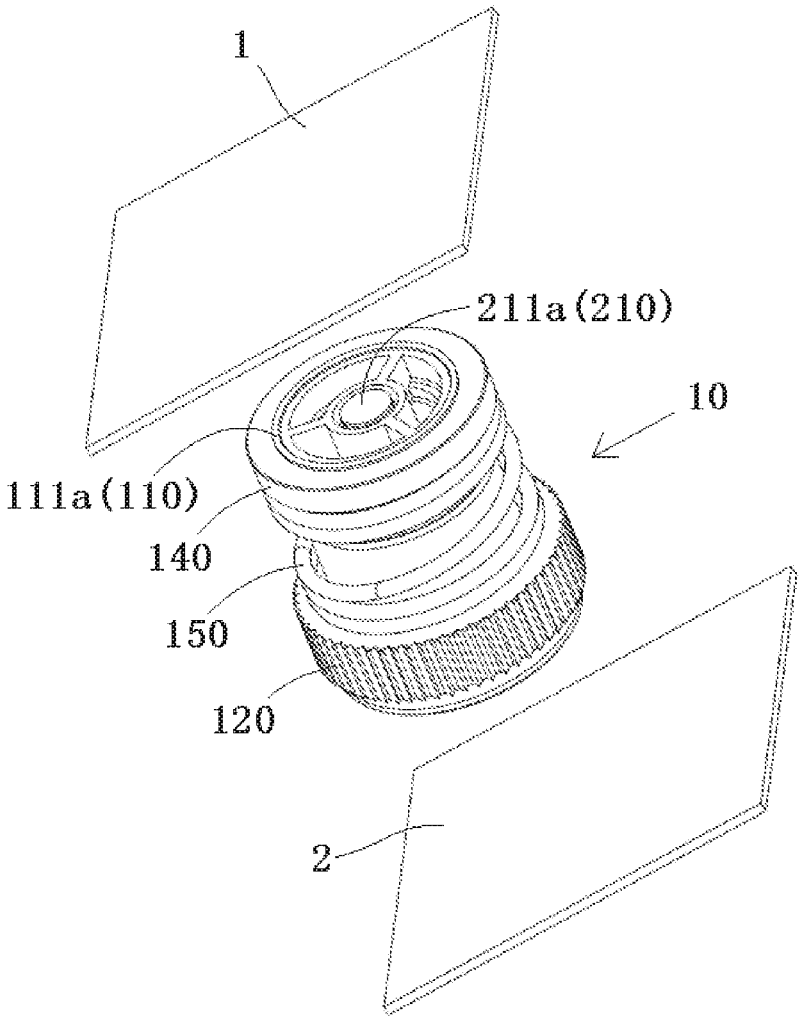
FIG. 1 is a perspective view of a connector according to an embodiment with a first electrical component and a second electrical component.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

A connector 10, as shown in FIG. 1, electrically connects a first electrical component 1 and a second electrical component 2. The connector 10, as shown in FIGS. 1 and 2, includes a pair of outer conductors 110, 120, a pair of center conductors 210, 220, an insulation seat 140, and an elastic element 150.

In an embodiment, the connector 10 is a radio frequency (RF) coaxial connector adapted to be electrically connected between the first electrical component 1 and the second electrical component 2. As shown in FIGS. 1 and 2, in an embodiment, the first electrical component 1 may be a circuit board, and the second electrical component 2 may be a circuit board or a filter.

Figure 2:
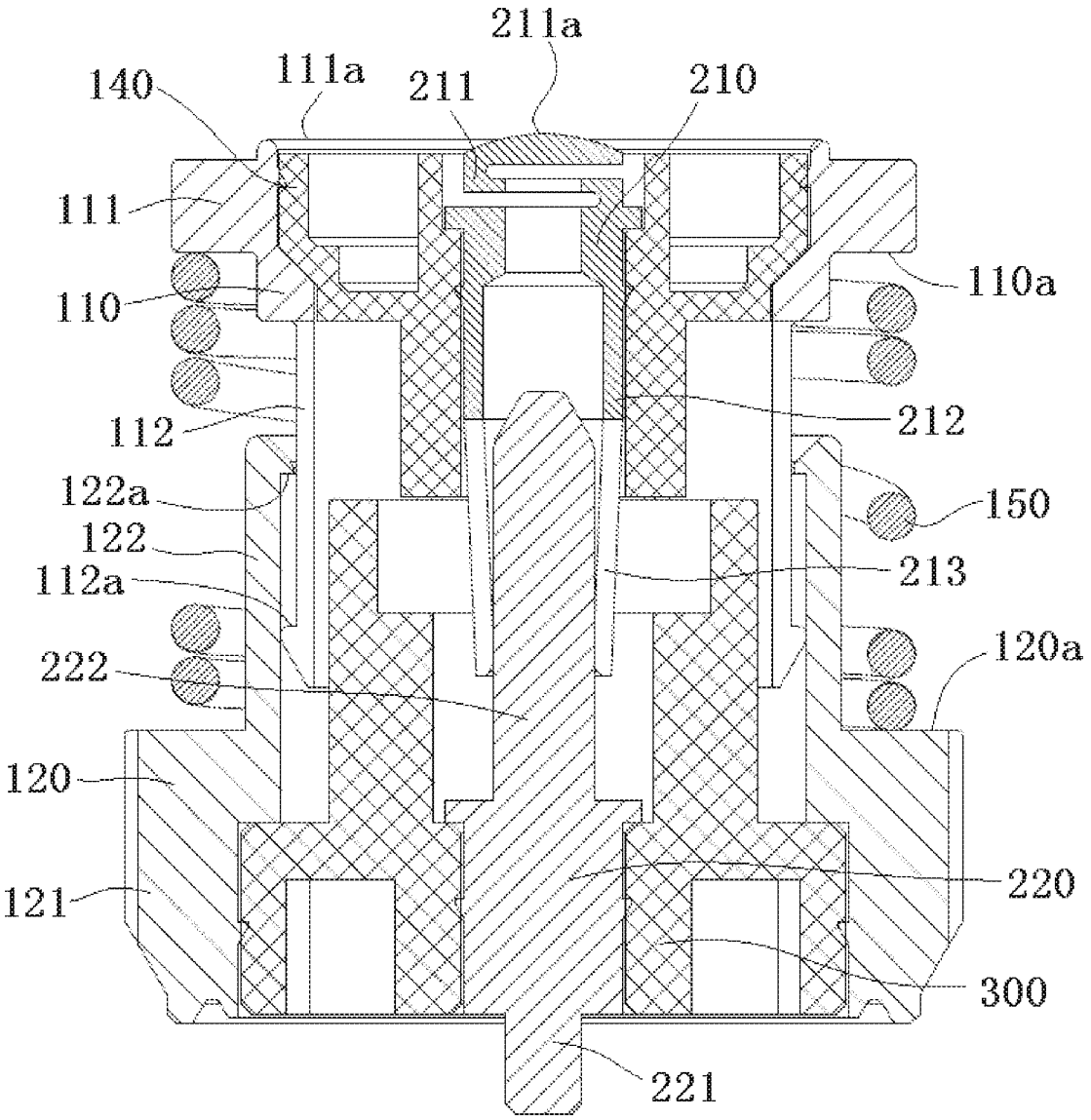
FIG. 2 is a sectional side view of the connector.

The outer conductors 110, 120, as shown in FIGS. 1 and 2, include a first outer conductor 110 and a second outer conductor 120 which are assembled together in such a way that they are slidably movable with respect to each other. The center conductors 210, 220 are disposed within the outer conductors 110, 120 and include a first center conductor 210 and a second center conductor 220 which are assembled together in such a way that they are slidably movable with respect to each other. The first outer conductor 110 is fixed to the insulation seat 140. A first end of the elastic element 150, an upper end in FIG. 2, abuts against the first outer conductor 110 or the insulation seat 140.

The first center conductor 210, as shown in FIGS. 1 and 2, is also fixed to the insulation seat 140, so that both the first outer conductor 110 and the first center conductor 210 are in electrical contact with a first electrical component 1 under a pushing or pressing force from the elastic element 150.

Figure 4:
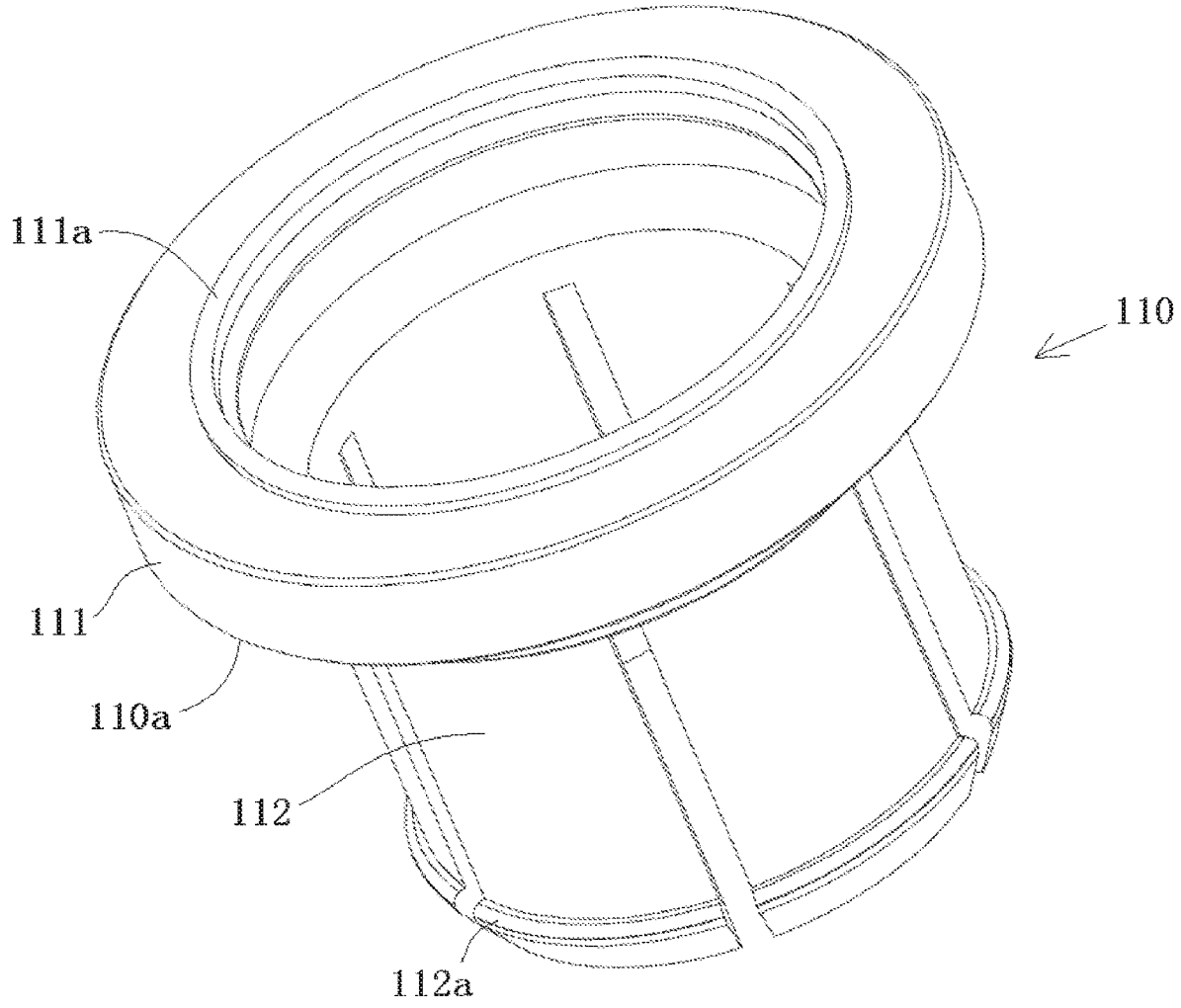
FIG. 4 is a perspective view of a first outer conductor of the connector.

The first outer conductor 110, as shown in FIGS. 1, 2, and 4, has a first outer conductor contact part 111*a* exposed from a surface of the insulation seat 140 and adapted to electrically contact with the first electrical component 1. In an embodiment, the first outer conductor 110 has an annular base 111, and the first outer conductor contact part 111*a* is an annular boss formed on the annular base 111.

Figure 6:
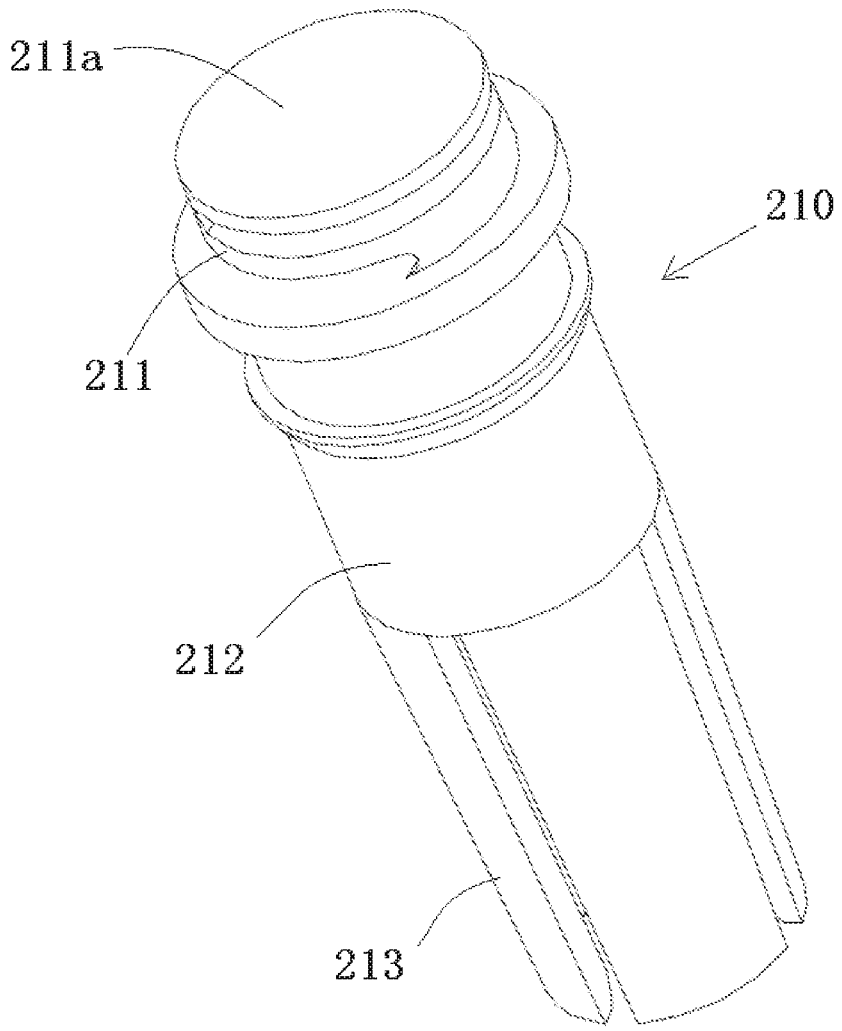
FIG. 6 is a perspective view of a first center conductor of the connector.

The first center conductor 210, as shown in FIGS. 1, 2, and 6, has a first center conductor contact part 211*a* exposed from the surface of the insulation seat 140 and adapted to electrically contact with the first electrical component 1.

As shown in FIGS. 1, 2 and 6, in an embodiment, an elastic structure 211 is formed on a first end, an upper end in FIG. 2, of the first center conductor 210. The elastic structure 211 is capable of being elastically deformed in an axial direction of the connector 10. The first center conductor contact part 211*a* is formed on a top end of the elastic structure 211, so that the first center conductor contact part 211*a* is movable in the axial direction of the connector 10.

The elastic structure 211, as shown in FIGS. 1, 2, and 6, may be elastically deformed in the axial direction of the connector 10, so that the position of the first center conductor contact part 211*a* may be adjusted in the axial direction of the connector 10. In this way, even if ends (e.g. top ends) of the first center conductor contact part 211*a* and the first outer conductor contact part 111*a* are not in the same plane in a non-contact state or in an initial state, the end of first center conductor contact part 211*a* may be adjusted to be in the same plane as the end of the first outer conductor contact part 111*a*, thereby ensuring that the first center conductor contact part 211*a* and the first outer conductor contact part 111*a* are in electrical contact with the first electrical component 1 at the same time.

As shown in FIGS. 1, 2, and 6, in an embodiment, the elastic structure 211 on the first center conductor 210 may also apply an auxiliary contact pressure to the first center conductor contact part 211*a* to ensure reliable electrical contact between the first center conductor contact part 211*a* and the first electrical component 1.

In an exemplary embodiment, the elastic structure 211 may be configured as a curved elastic structure. In the embodiment shown in FIGS. 1, 2 and 6, the elastic structure 211 has an S-shape. In other embodiments, the elastic structure 211 may also have any other shape as long as it may be elastically deformed in the axial direction.

Figure 3:
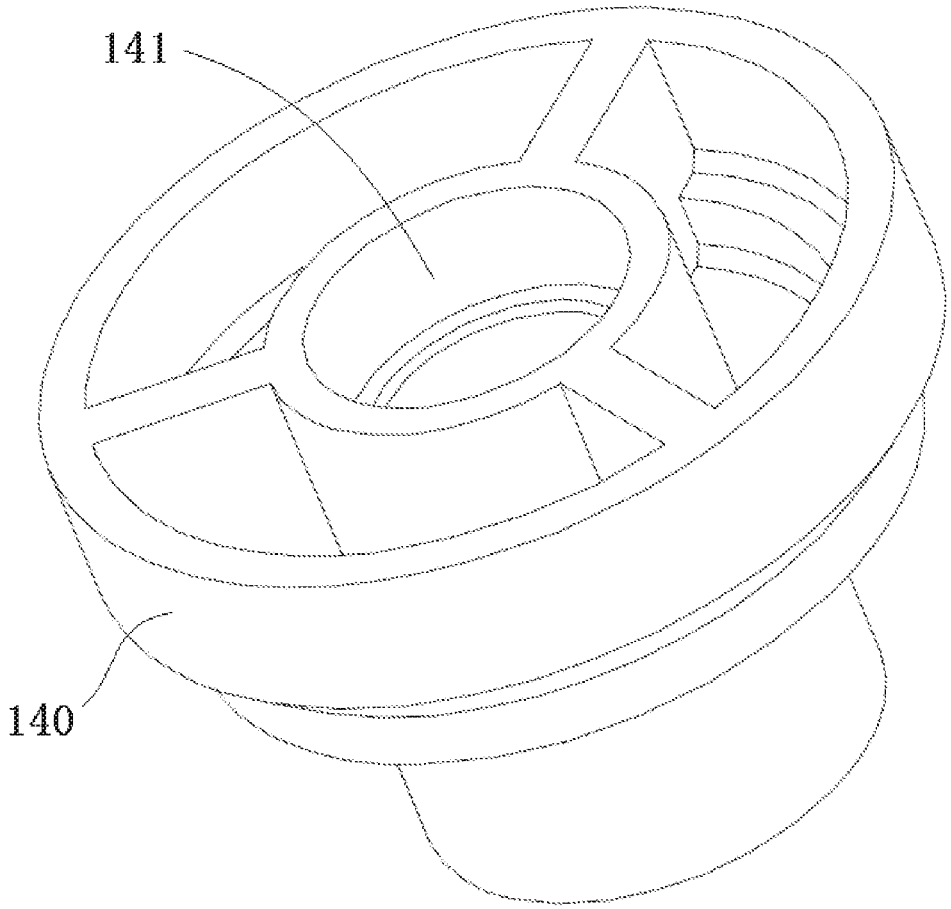
FIG. 3 is a perspective view of an insulation seat of the connector.

As shown in FIGS. 2, 3, and 6, a central through hole 141 is formed in the insulation seat 140, and the elastic structure 211 of the first center conductor 210 passes through the central through hole 141 of the insulation seat 140.

The insulation seat 140 is molded onto the first outer conductor 110 and the first center conductor 210, as shown in FIGS. 1 and 2. In this way, the first outer conductor 110 and the first center conductor 210 may be fixed to the insulation seat 140 at the same time. In other embodiments, the first outer conductor 110 and the first center conductor 210 may also be assembled onto a pre-formed insulation seat 140.

Figure 5:
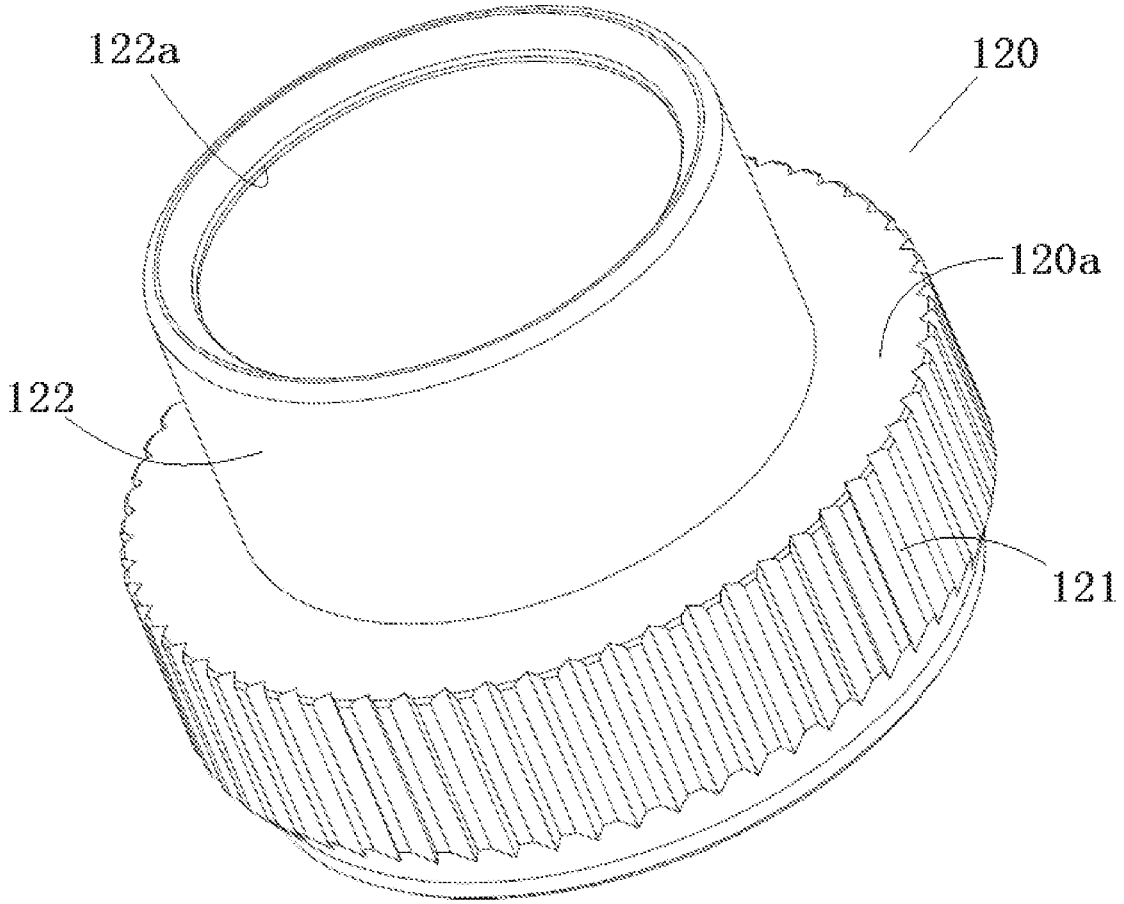
FIG. 5 is a perspective view of a second outer conductor of the connector.

The second outer conductor 120, as shown in FIGS. 1, 2, and 5, has a cylindrical body 122 at an end thereof. The first outer conductor 110 is slidably inserted into the cylindrical body 122 of the second outer conductor 120, and is in electrical contact with the second outer conductor 120 in a slidable manner.

A plurality of elastic arms 112 are formed on the first outer conductor 110, as shown in FIGS. 2 and 4. A bulge 112*a* is formed on each of the elastic arms 112, and the bulges 112*a* on the elastic arms 112 are adapted to be electrical contact with the inner wall of the second outer conductor 120 in a slidable manner.

As shown in FIGS. 2 and 5, in an embodiment, an annular stop lip 122*a* is formed on an inner side of an end opening of the cylindrical body 122 and protrudes inwardly. The stop lip 122*a* is adapted to block or stop the bulges 112*a* on the elastic arms 112 of the first outer conductor 110 from sliding outward, so as to prevent the first outer conductor 110 from being detached from the second outer conductor 120.

Figure 7:
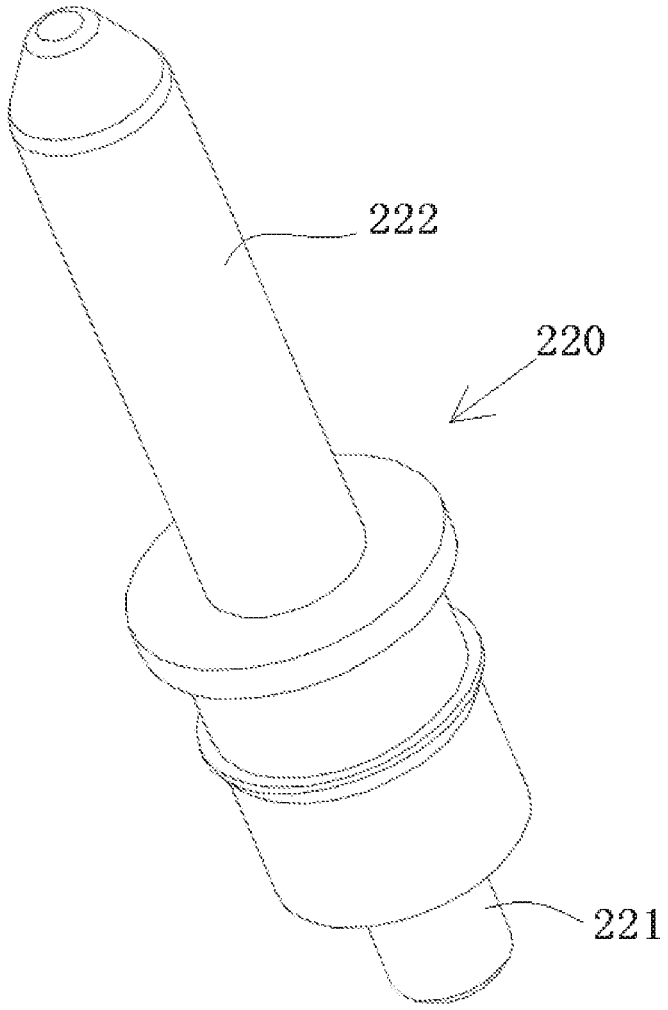
FIG. 7 is a perspective view of a second center conductor of the connector.

The first center conductor 210 has a cylindrical part 212, as shown in FIGS. 2 and 6. The second center conductor 220 has a rod part 222, as shown in FIG. 7. The rod part 222 of the second center conductor 220 is slidably inserted into the cylindrical part 212 of the first center conductor 210, and is in contact with the first center conductor 210 in a slidable manner.

As shown in FIGS. 2 and 6, in an embodiment, a plurality of elastic contact arms 213 are formed on the cylindrical part 212 of the first center conductor 210. The elastic contact arms 213 of the first center conductor 210 are adapted to be in electrical contact with an outer wall of the rod part 222 of the second center conductor 220 in a slidable manner.

In other embodiments, the first center conductor 210 and the second center conductor 220 may be connected by an elastic component, such as a spring. In another embodiment, the first center conductor 210 and the second center conductor 220 may be formed into an integrated metal component by stamping a single metal piece, and an elastic part, such as a curved elastic sheet, may be formed between the first center conductor 210 and the second center conductor 220.

In an embodiment, the first outer conductor 110, the first center conductor 210, and the second center conductor 220 may each be machined pieces made by machining.

As shown in FIG. 2, the insulation seat 140 is provided between the first outer conductor 110 and the first center conductor 210.

The first outer conductor 110 has a first positioning flange 110*a* extending outwardly and the second outer conductor 120 has a second positioning flange 120*a* extending outwardly, as shown in FIGS. 2, 4, and 5. The elastic element 150 is located outside of the outer conductors 110 and 120. A pair of ends of the elastic element 150 are supported on or abut against the first positioning flange 110*a* and the second positioning flange 120*a* respectively.

The connector 10, as shown in FIG. 2, includes an insulating support 300 arranged between the second outer conductor 120 and the second center conductor 220 and holding the second center conductor 220 within the second outer conductor 120.

As shown in FIGS. 1 and 2, in an embodiment, a base end 121 of the second outer conductor 120 is adapted to be welded, inserted into, or threaded to a second electrical component 2. A base end 221 of the second center conductor 220 is adapted to be welded, inserted into or threaded to the second electrical component 2.

Figure 8:
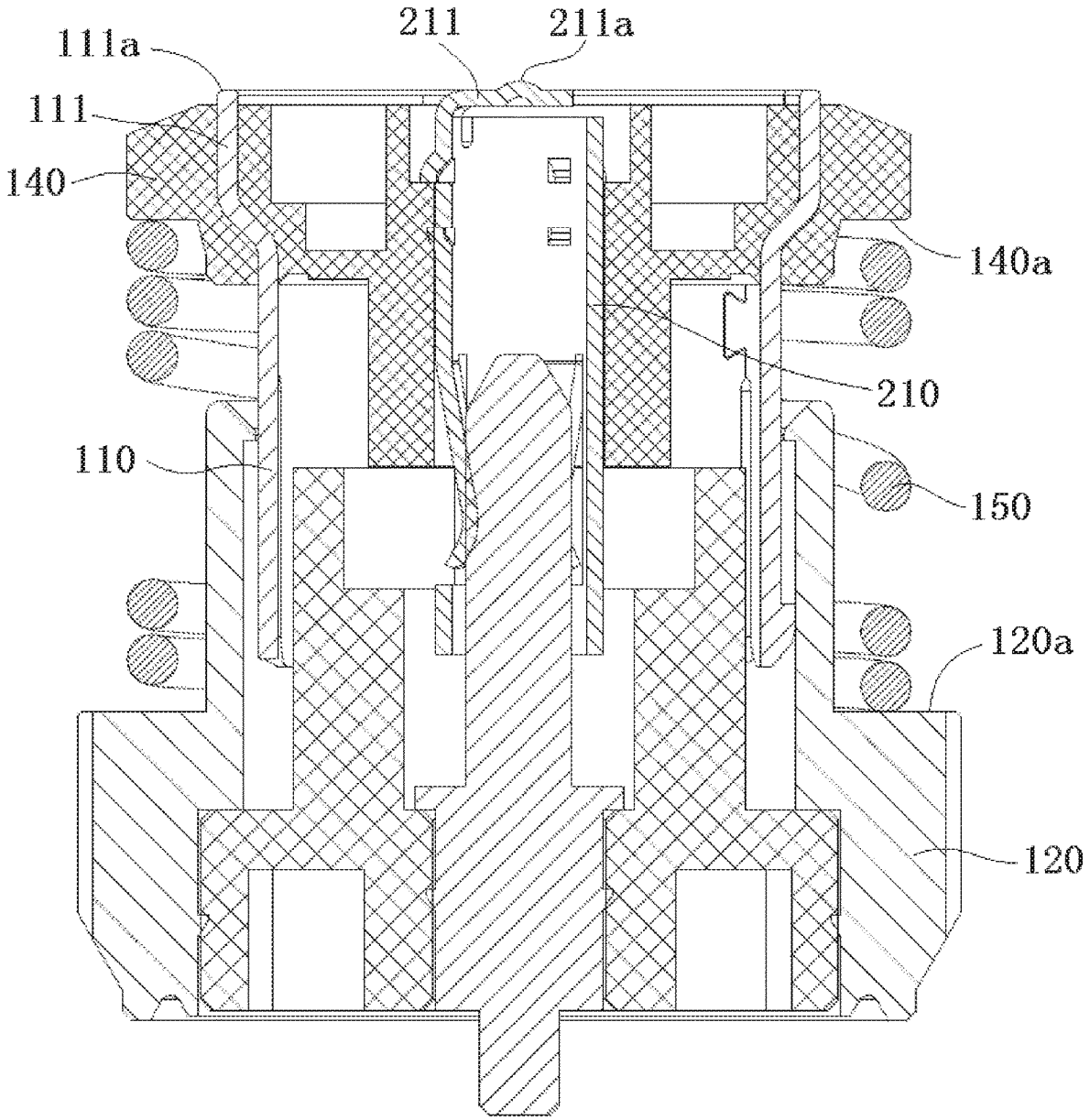
FIG. 8 is a sectional side view of a connector according to another embodiment.

A connector according to another embodiment is shown in FIG. 8. Like reference numbers refer to like elements, and only the differences with respect to the connector 10 shown in FIGS. 1-7 will be described in detail herein.

As shown in the embodiment of FIG. 8, the first outer conductor 110 and the first center conductor 210 are arranged inside the insulation seat 140. The insulation seat 140 has a first positioning flange 140*a* extending outwardly, and the second outer conductor 120 has a second positioning flange 120*a* extending outwardly. A pair of ends of the elastic element 150 are supported on or abut against the first positioning flange 140*a* and the second positioning flange 120*a* respectively.

In the embodiment shown in FIG. 8, the first outer conductor 110 is a single conductive component formed by stamping a single sheet of metal plate, the first center conductor 210 is a single conductive component formed by stamping a single sheet of metal plate, and/or the second center conductor 220 is a single conductive component formed by stamping a single sheet of metal plate.

In another embodiment, a connector comprises outer conductors 110, 120, center conductors 210, 220, an insulation seat 140, and an elastic element 150. The outer conductors include a first outer conductor 110 and a second outer conductor 120 which are assembled together in such a way that they are slidably movable with respect to each other. The center conductors 210, 220 (which may be formed into an integrated component) are disposed within the outer conductors 110, 120. The first outer conductor 110 is fixed to the insulation seat 140. A first end of the elastic element 150 abuts against the first outer conductor 110 or the insulation seat 140. The center conductors 210, 220 are also fixed to the insulation seat 140, so that both the first outer conductor 110 and the center conductor 210, 220 are in electrical contact with a first electrical component 1 under a pushing or pressing force from the elastic element 150.

As described in various exemplary embodiments, both the first outer conductor 110 and the first center conductor 210 are fixed to the insulation seat 140. Thereby, the first outer conductor 110 and the first center conductor 210 may both electrically contact the first electrical component 1 under the pushing or pressing of the elastic element 150, which can not only improve the high frequency performance and passive intermodulation performance of the connector, but also simplify the structure of the connector, reduce the axial length of the connector, and save costs in manufacturing the connector.

It should be appreciated for those skilled in this art that the above embodiments are intended to be illustrative, but not restrictive. For example, many modifications may be made to the above embodiments by those skilled in this art, and various features described in different embodiments may be freely combined with each other without conflicting in configuration or principle. Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A connector, comprising:

a pair of outer conductors including:

a first outer conductor having an elastic structure on an end thereof and a first outer conductor contact part formed on a top end of the elastic structure, the elastic structure is elastically deformable in an axial direction of the connector for enabling movement of the first conductor contact part in the axial direction; and a second outer conductor having a first center conductor contact part, the first outer conductor and the second outer conductor assembled together and slidable with respect to each other;

a pair of center conductors arranged within the outer conductors, the center conductors including a first center conductor and a second center conductor assembled together and slidable with respect to each other;

an insulation seat, the first outer conductor and the first center conductor are fixed to the insulation seat, the first outer conductor contact part and the first center conductor contact part exposed from a surface of the insulation seat; and an elastic element, a first end of the elastic element abuts against the first outer conductor or the insulation seat, the first outer conductor contact part and the first center conductor contact part are both in electrical contact with a first electrical component under a pressing force from the elastic element.

2. The connector of claim 1, wherein the elastic structure is a curved elastic structure.

3. The connector of claim 2, wherein the elastic structure has an S-shape.

4. The connector of claim 1, wherein the insulation seat has a central through hole, the elastic structure of the first center conductor extends through the central through hole.

5. The connector of claim 1, wherein the second outer conductor has a cylindrical body at an end, the first outer conductor is slidably inserted into the cylindrical body of the second outer conductor and is in slidable electrical contact with the second outer conductor.

6. The connector of claim 5, wherein the first outer conductor has a plurality of elastic arms each having a bulge, the bulge is in slidable electrical contact with an inner wall of the second outer conductor.

7. The connector of claim 6, wherein the cylindrical body has an annular stop lip on an inner side of an end opening, the annular stop lip protrudes inwardly and stops the bulges on the elastic arms from sliding outward, preventing the first outer conductor from being detached from the second outer conductor.

8. The connector of claim 1, wherein the first center conductor has a cylindrical part and the second center conductor has a rod part, the rod part is slidably inserted into the cylindrical part and is in slidable electrical contact with the first center conductor.

9. The connector, wherein the cylindrical part has a plurality of elastic contact arms, the elastic contact arms are in slidable electrical contact with an outer wall of the rod part.

10. The connector of claim 1, wherein the first outer conductor and the first center conductor are arranged within the insulation seat.

11. The connector of claim 10, wherein the insulation seat has a first positioning flange extending outwardly and the second outer conductor has a second positioning flange extending outwardly, a pair of ends of the elastic element abut against the first positioning flange and the second positioning flange.

12. The connector of claim 1, further comprising an insulating support arranged between the second outer conductor and the second center conductor, the insulating support holding the second center conductor within the second outer conductor.

13. The connector of claim 1, wherein the second outer conductor has a base end welded, inserted into, or threaded to a second electrical component, and the second center conductor has a base end welded, inserted into, or threaded to the second electrical component.

14. A connector, comprising:

a pair of outer conductors including a first outer conductor and a second outer conductor assembled together and slidable with respect to each other;

a pair of center conductors arranged within the outer conductors, the center conductors including a first center conductor and a second center conductor assembled together and slidable with respect to each other;

an insulation seat molded onto the first outer conductor and the first center conductor for fixing first outer conductor and the first center conductor to the insulation seat; and an elastic element, a first end of the elastic element abuts against the first outer conductor or the insulation seat, the first outer conductor and the first center conductor are both in electrical contact with a first electrical component under a pressing force from the elastic element, insulation seat is molded onto the first outer conductor and the first center conductor.

15. The connector of claim 14, wherein the first outer conductor has a first outer conductor contact part exposed from a surface of the insulation seat and electrically contacting the first electrical component, and the first center conductor has a first center conductor contact part exposed from the surface of the insulation seat and electrically contacting the first electrical component.

16. The connector of claim 15, wherein the first center conductor has an elastic structure on an end, the elastic structure is elastically deformable in an axial direction of the connector, the first center conductor contact part is formed on a top end of the elastic structure and is movable in the axial direction.

17. The connector of claim 15, wherein the first outer conductor has an annular base, the first outer conductor contact part is an annular boss formed on the annular base.

18. A connector of claim 1, comprising:

a pair of outer conductors including a first outer conductor having a first positioning flange extending outwardly, and a second outer conductor having a second positioning flange extending outwardly, the first and second outer conductors assembled together and slidable with respect to each other;

a pair of center conductors arranged within the outer conductors, the center conductors including a first center conductor and a second center conductor assembled together and slidable with respect to each other;

an insulation seat is disposed between the first outer conductor and the first center conductor, the first outer conductor and the first center conductor are fixed to the insulation seat; and an elastic element having a first end abutting against the first positioning flange of the first outer conductor and a second end abutting against the second positioning flange of the second outer conductor, the first outer conductor and the first center conductor are both in electrical contact with a first electrical component under a pressing force from the elastic element.

19. A connector, comprising:

a pair of outer conductors including a first outer conductor and a second outer conductor assembled together and slidable with respect to each other;

a center conductor arranged within the outer conductors;

an insulation seat, the first outer conductor and the center conductor are fixed to and arranged within the insulation seat; and an elastic element, a first end of the elastic element abuts against the first outer conductor or the insulation seat, the first outer conductor and the center conductor are both in electrical contact with a first electrical component under a pressing force from the elastic element.

* * * * *